United States Patent [19]

Strasser

[11] Patent Number: 4,463,856

[45] Date of Patent: Aug. 7, 1984

[54] THEFT-PREVENTIVE JEWELRY DISPLAY STAND

[75] Inventor: Andy Strasser, Carlstadt, N.J.

[73] Assignee: General Mills Products Corp., Minneapolis, Minn.

[21] Appl. No.: 232,436

[22] Filed: Feb. 8, 1981

[51] Int. Cl.[3] ..... A47B 49/00

[52] U.S. Cl. ..... 211/163; 312/125

[58] Field of Search ..... 211/13, 163, 162, 169; 108/103; 312/140, 204, 257 A, 265, 125, 117; 232/43.2

[56] References Cited

U.S. PATENT DOCUMENTS

| | | | |
|---|---|---|---|
| 436,135 | 9/1890 | Hoffmann | 312/125 X |
| 462,130 | 10/1891 | Herfort | 312/125 |
| 887,715 | 5/1908 | Xander | 108/94 |
| 1,059,781 | 4/1913 | Stephen | 312/125 X |
| 1,361,334 | 12/1920 | Kaley | 211/163 |
| 1,596,980 | 8/1926 | Koster | 211/163 |
| 1,828,088 | 10/1931 | Robinson | 312/265 X |
| 3,179,070 | 4/1965 | Beller | 108/103 |
| 3,866,824 | 2/1975 | Lewis | 232/43.2 |
| 4,126,366 | 11/1978 | Handler | 312/125 X |

FOREIGN PATENT DOCUMENTS

| | | | |
|---|---|---|---|
| 1194133 | 5/1959 | France | 211/163 |
| 6466 | of 1900 | United Kingdom | 312/265 |

*Primary Examiner*—William E. Lyddane
*Assistant Examiner*—Peter A. Aschenbrenner

[57] ABSTRACT

The jewelry display stand comprises a plurality of substantially vertical, rectangular side panels of equal height connected to each other at their vertical edges and mounted on and secured to a preferably circular flat bottom piece. One of the side panels may be a mirror panel, but at least one of the side panels is a display panel having a plurality of vertically oriented display arms extending perpendicularly therefrom parallel to the vertical edges of said display panel. Adjacent display arms contain opposing vertical slots running the length of the display arms. The slots are of such depth that rectangular jewelry display cards having earrings and the like attached thereto may be slidably mounted and held on the display panel. The jewelry display stand is also provided with a detachable decorative lid which can sit flush on and cover the top of the side panels and vertical slots to prevent theft of jewelry mounted on the display cards. The jewelry display stand may be made rotatable by attaching the bottom piece to a rotatable base.

5 Claims, 7 Drawing Figures

THEFT-PREVENTIVE JEWELRY DISPLAY STAND

THE FIELD OF THE INVENTION

This invention relates to merchandise display stands and more particularly to improved jewelry display stands for earrings and the like which reduce incidences of theft while still providing for convenient display and sale of jewelry.

BACKGROUND OF THE INVENTION

A vendor often displays inexpensive jewelry such as earrings and the like by mounting the jewelry securely on small mounting cards. These cards are hung or hooked on a comparatively simple wire frame stand or rack in a way that they can be comparatively easily attached or detached for convenient merchandising. While jewelry can be conveniently rearranged on, added to or removed from such displays by the vendor, they offer no protection to theft by the passerby. More expensive rings, earrings and the like may be kept locked inside a counter display case, but this procedure makes such items difficult to view by the customer and requires the vendor to remove them for the customer's viewing.

It is the object of this invention to provide a novel jewelry display stand for earrings and the like which reduces theft.

It is a further object of this invention to provide such an improved display stand for holding merchandise mounted on display cards which provides reasonable access to the vendor.

It is also an object of this invention to provide such an improved jewelry display stand which is rotatable for the convenient display and sale of items mounted thereon.

It is another object of this invention to provide a novel rotatable stand useful in the display and sale of jewelry and the like having mirrors mounted thereon which minimizes theft and provides additional sales aids.

SUMMARY OF THE INVENTION

The novel jewelry display stand of this invention comprises a plurality of substantially vertical, rectangular jewelry display side panels of equal height and may contain at least one substantially vertical, rectangular mirror side panel. The side panels are mounted on and secured to a horizontal, preferably circular, bottom piece. The vertical edges of each of the side panels are connected to the vertical edges of adjacent side panels to form a jewelry display stand having a horizontal cross section that is a polygon. In the preferred embodiment there are six side panels of equal width including one mirror panel so that the cross-section of the novel jewelry stand is hexagonal.

The invention also has a decorative detachable lid which covers and sits flush on the top of the jewelry display and mirror side panels. The jewelry display side panels have extending perpendicularly therefrom a plurality of vertical display arms parallel to and of the same length as the vertical edges of the side panels. The display arms are preferably equally spaced from each other. Adjacent display arms have in their opposing faces opposing vertical slots running their length. The distance between said adjacent vertical arms and the depth of said slots is such that display cards having earrings and the like attached thereto may be placed on the novel display stand by sliding them into said opposing slots between said adjacent display arms, when the detachable lid is removed. However, when the decorative lid is attached so as to sit flush on the tops of the side panels covering the opposing vertical slots in said adjacent display arms, it is not possible to slide the display cards having jewelry mounted thereon from the stand. Since considerable effort is required to detach the lid including removal of several comparatively inaccessible nuts, theft of jewelry by the passerby is eliminated unless the stand is inadvertently placed out of view of the vendor and his assistants. For easy access by the vendor and viewing by the customer, the entire jewelry display stand may be made rotatable by attaching the bottom piece to a rotatable base.

BRIEF DESCRIPTION OF THE DRAWINGS

The invention may be better understood from the following detailed description which refers to the accompanying drawings in which.

DETAILED DESCRIPTION OF THE INVENTION

Figure 1:
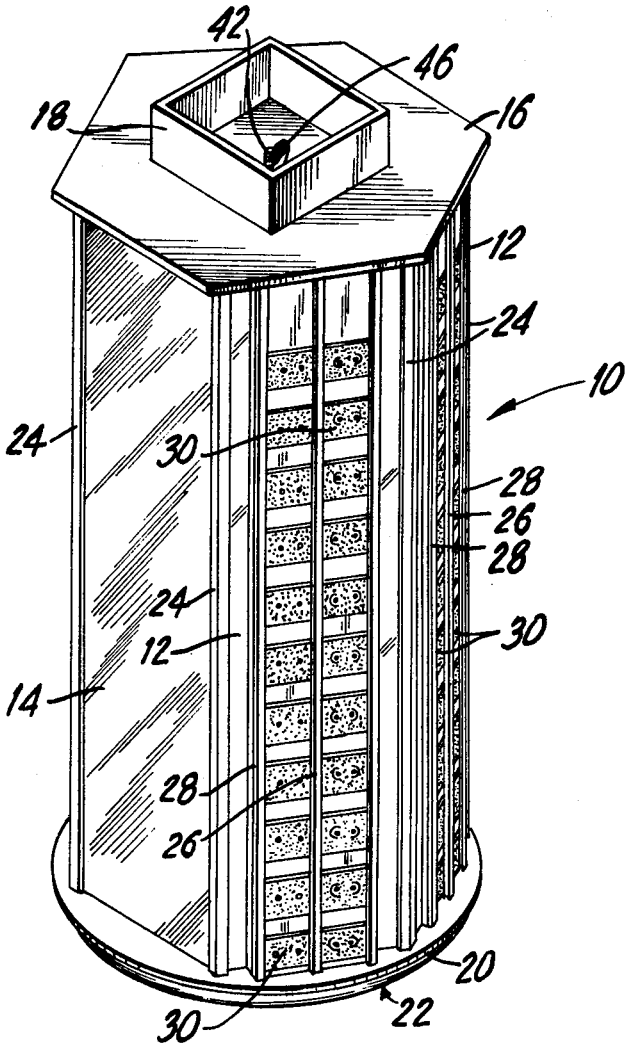
FIG. 1 is a perspective view of the novel jewelry display stand 10 according to this invention.

As shown in FIG. 1, the display stand 10 has a plurality of substantially vertical, rectangular display side panels 12 for mounting jewelry thereon and may contain at least one substantially vertical, rectangular mirror side panel 14. The display side panels 12 and mirror side panel 14 are mounted on and supported by a substantially flat horizontal, bottom piece 20. The mirror panel 14 and display side panels 12 are of substantially equal height and in the preferred embodiment shown in the drawings are of equal width. Adjacent side panel 14 and display side panels 12 are attached together by substantially vertical panel rails 24. A decorative lid 16 having a handle 18 is detachably secured to the jewelry display stand 10 and is conformed so as to cover and to sit flush on the tops of the display side panels 12 and the mirror panel 14. The bottom piece 20 is preferably circular and may be attached to a rotatable base 22 so that the entire jewelry stand 10 is rotatable for use in convenient over-the-counter sale of jewelry. In this preferred embodiment the display stand is six-sided, has a hexagonal cross-section and one mirror side panel 14.

Figure 2:
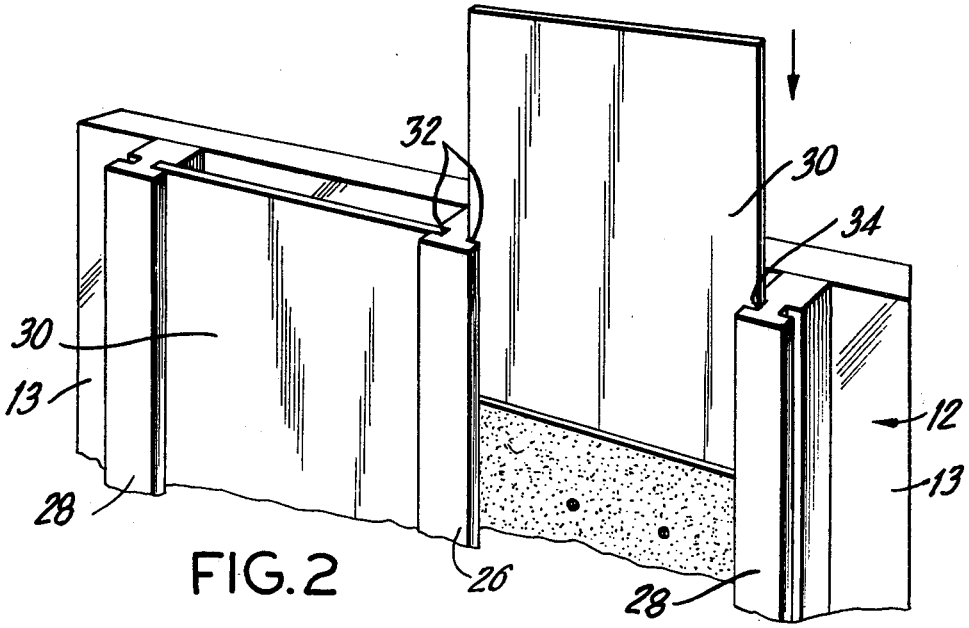
FIG. 2 is a perspective cutaway view of the display side panel 12 of the jewelry display stand of FIG. 1.

The jewelry display panel 12 is shown in greater detail in FIG. 2. Display side panel 12 is substantially rectangular and in the preferred embodiment has a vertical central display arm 26 and two vertical edge display arms 28 having length equal to that of vertical edge 13 and extending substantially perpendicularly from the display side panel 12. In general, display side panel 12 may have a plurality of display arms 26 and 28 extending perpendicularly from the side panel 12, preferably equally spaced from each other. In the preferred embodiment central display arm 26 is positioned near the center of the side panel 12, while the edge arms 28 are positioned adjacent the vertical edges 13 of the side panel 12, preferably equidistant from said central arm 26. Central display arm 26 has two vertically disposed slots 32, each slot 32 facing an edge display arm 28. Each edge display arm 28 has a vertical slot 34 opposed to a vertical slot 32 in central display arm 26. The vertical slots 32 and 34 extend the entire length of edge display arm 28 and central display arm 26 and are of such depth that jewelry display cards 30, having earrings or the like attached thereto, can be slidably mounted on side panel 12 and held between the central display arm 26 and either of the side display arms 28. A plurality of jewelry display cards 30, having earrings or the like, can be mounted on the jewelry stand 10 in this manner. When decorative lid 16 is secured to the top of the jewelry display stand 10, as shown in FIG. 1, the top of the side panel 12 and slots 32 and 34 are covered preventing removal of the jewelry display cards 30. When lid 16 is removed, preferably by loosening and removing comparatively inaccessible wing nut 46 on bolts 42, the display cards may be lifted from the slots and its jewelry sold or examined, and the display added to or rearranged at the discretion of the vendor or his assistants. Preferably display panel 12 and bottom piece 20 are constructed of a molded plastic.

Figure 3:
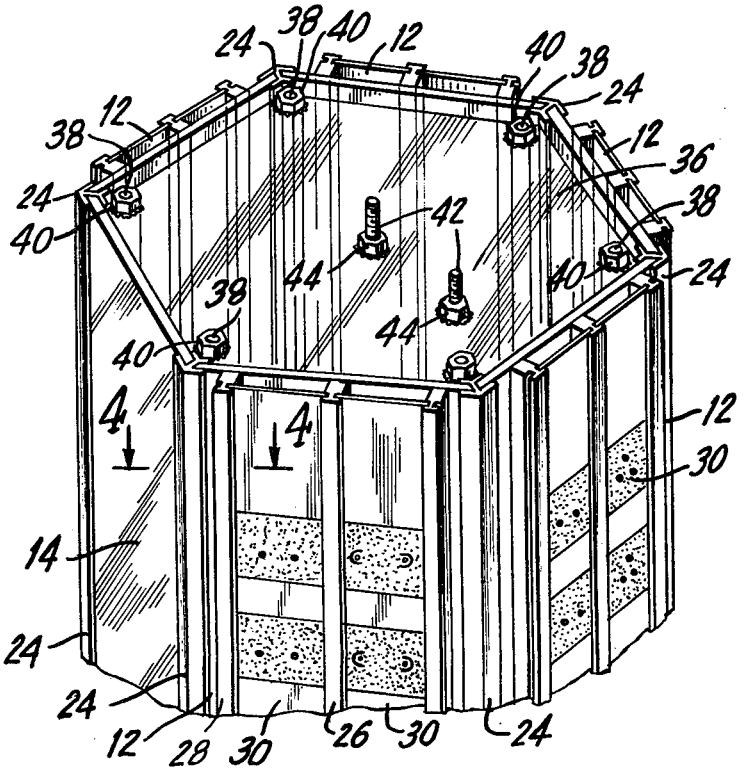
FIG. 3 is a top perspective cutaway view of the display stand 10 of FIG. 1 with decorative lid 16 detached therefrom.
Figure 4:
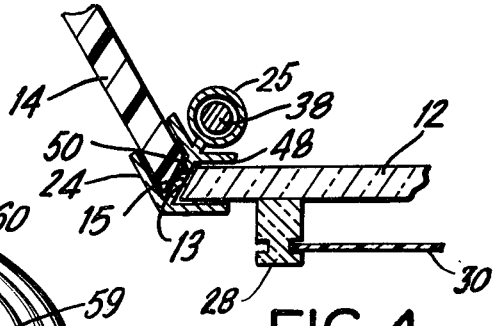
FIG. 4 is a partial cross-sectional view along the line 4—4 of FIG. 3.
Figure 5:
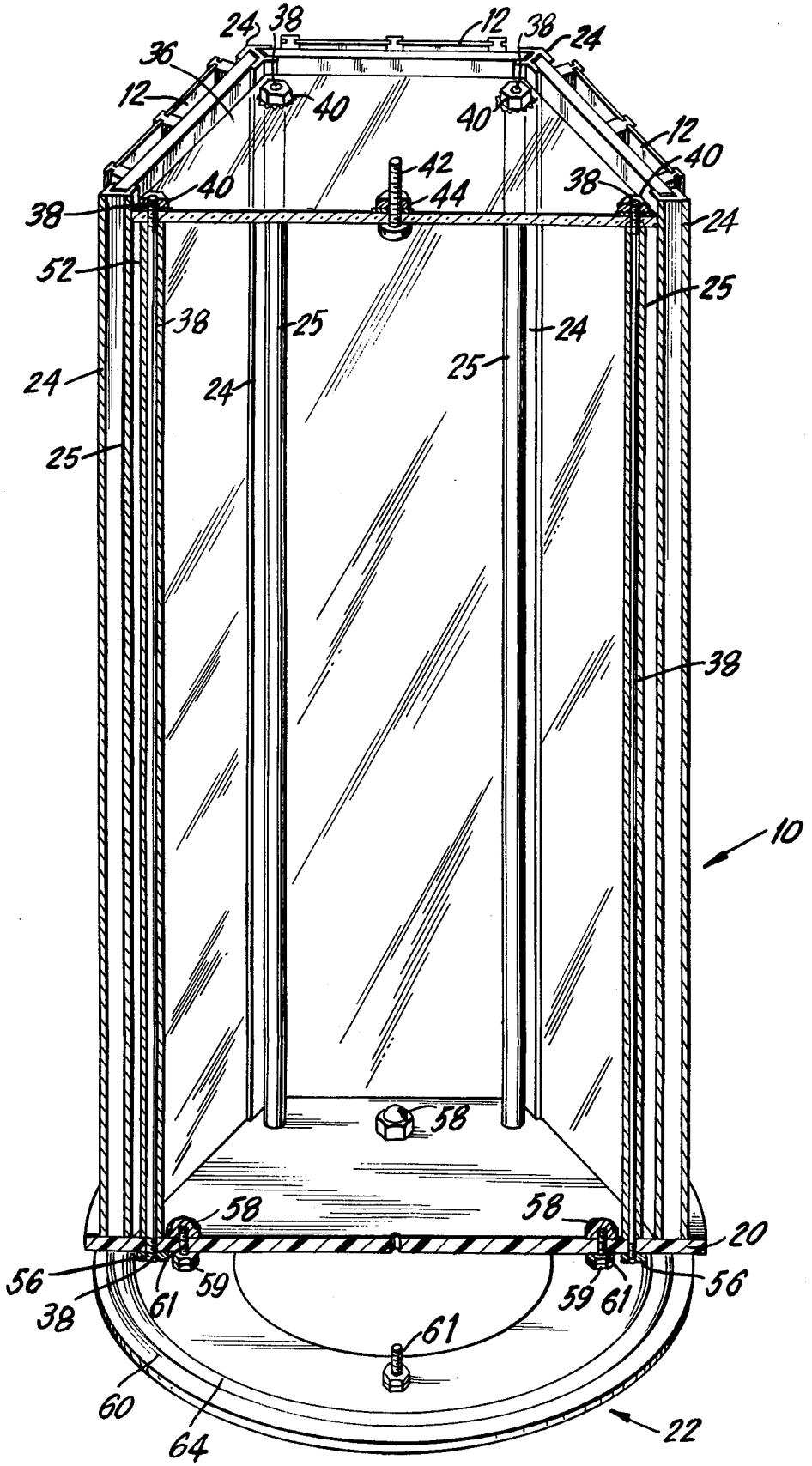
FIG. 5 is a cutaway view of the jewelry display stand FIG. 1 with decorative lid 16 removed.

The construction of the preferred embodiment of the jewelry stand 10 is shown in greater detail in FIGS. 3–5. Display panels 12 and mirror panel 14 are slidably mounted in and connected to adjacent side panels 12 or 14 by panel rails 24. Each panel rail 24 has a vertical slot 50 and on the opposite side thereof a vertical slot 48. The slots 50 and 48 are shaped so as to receive and hold the vertical edges 13 of display side panels 12 and vertical edges 15 of mirror panel 14. In the preferred embodiment the vertical slots 50 and 48 are so oriented in opposite sides of panel rail 24 that adjacent side panels 12 or 14 are held at an angle of 120°, so that the cross-section of said jewelry stand 10 is hexagonal.

Panel rails 24, mirror panel 14, and side panels 12 are preferably supported on bottom piece 20 by rods 38 passing through rail rubes 25 which are attached to panel rails 24 as shown in cross-section in FIG. 4. Top piece 36, preferably of a transparent plastic, sits on top of rail tubes 25 which are shorter than panel rails 24, but of equal height with each other, so that the top piece 36 is horizontal and recessed from the top of said display side panels 12 and the mirror side panel 14. Display stand 10 is held together in the preferred embodiment by rods 38, threaded at both ends, which pass through rail tubes 25, top piece 36 and bottom piece 20 and which are held fixed in position by top nuts 40 and bottom nuts 56.

The top piece 36 is horizontal and recessed from the top of said display side panels 12 and the mirror panel 14 so that the decorative lid 16 sits flush on the top of the mirror side panel 14 and the display panels 12 without interference from protruding rods 38. At least one, but preferably two, of the bolts 42 protrude upwardly through the top piece 36 and are attached to it by nuts 44. The bolts 42 are of sufficient length to extend through decorative lid 16 and are secured to the top of display stand 10 by wing nuts 46. One of the bolts 42 is centered, and so shown in FIG. 5, and both bolts are shown in FIG. 3. Decorative lid 16 is preferably of an opaque plastic and has a decorative handle 18 molded thereon. Handle 18 makes it more difficult for the passerby to remove wing nuts 46 from the bolts 42. In the preferred embodiment handle 18 is rectangular in cross-section.

Figure 6:
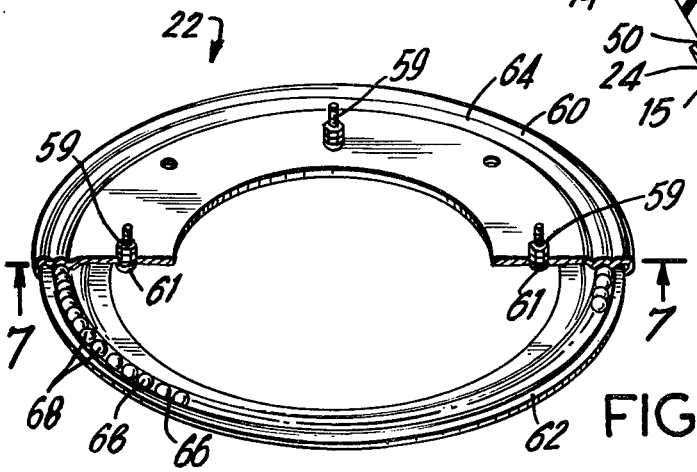
FIG. 6 is a top perspective cutaway view of the rotatable base 22 shown in FIG. 5.
Figure 7:
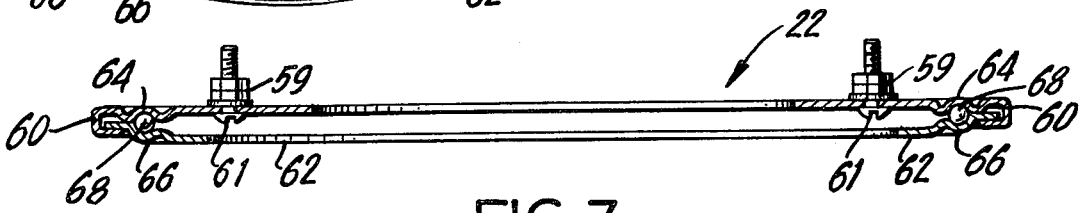
FIG. 7 is a sectional view taken along line 7—7 of FIG. 6.

For convenient access and viewing of all display side panels 12 the bottom piece 20 may be attached to a rotatable base 22 by bolts 61 and nuts 58, the base 22 being spaced from the bottom piece 20 by spacer means 59, preferably plurality of nuts. FIGS. 5–7 show structural details of the preferred rotatable base 22. The base 22 comprises an upper circular plate 60, a lower circular plate 62 of smaller radius than the upperplate 60, an upwardly directed circular groove 64 in the upper circular plate 60, and a downwardly directed circular groove 66 of equal radius as the upwardly directed groove 64 in the lower circular plate 62. The circular groove 64 opposes the circular groove 66 to form a race for spherical ball bearings 68, the bearings 68 being of a size to separate groove 64 from groove 66. The outer periphery of plate 60 extends downwardly and inwardly to press plate 62 upwardly against said bearings 68 and to retain said bearings 68 in the race formed by circular groove 64 and 66 without restricting the rotation thereof. Downwardly directed groove 66 projects below the lowest point of the outer periphery of plate 60 to form a circular seat for rotatable base 22. Bolts 61 securing bottom piece 20 to rotatable base 22 pass through plate 60 and are fixed in position by nuts 58. Rotatable base 22 is preferably of metal.

In operation, jewelry display cards 30 are mounted on the jewelry display 10 by the vendor or his assistants by removing decorative lid 16 and sliding the display cards 30 into vertical slots 32 and 34 in display arms 28 and 26. Lid 16 is then reattached using wing nuts 46 and the jewelry stand 10 is positioned for display. When lid 16 is attached, jewelry display cards 30 cannot be removed from the jewelry stand since lid 16 covers the top of display side panel 12 and slots 32 and 34. A moderate degree of attention on the part of the vendor and his assitants will prevent removal of lid 16 by the casual passerby or shoplifter. In the preferred embodiment the vendor or the customer can rotate the display so that all items can be viewed.

I claim:

1. An improved jewelry display stand useful in preventing theft comprising a flat, horizontally disposed bottom piece; a plurality of substantially vertical, rectangular side panels of substantially equal height mounted on and secured to said bottom piece; each of said side panels connected to an adjacent side panel; said side panels being of equal width so that said display stand has a hexagonal cross-section and at least one of said side panels is a mirror side panel; at least one of said side panels being a display side panel having a plurality of substantially vertical display arms extending perpendicularly from said display panel; a lid which is hexagonal and has affixed thereon a handle and is of sufficient area and shape to cover the tops of said display arms; each of said display arms having at least one vertically oriented slot, said vertically oriented slots in said display arms adjacent to each other facing and opposing each other so that jewelry display cards on which earrings and the like are mounted can be slidably mounted between and held by said display arms when said lid is detached from said jewelry display stand, but cannot be removed therefrom when said lid is attached; wherein said adjacent side panels are connected to each other by substantially vertical display panel rails, said panel rails having vertical slots therein conformed so as to receive said vertical edges of said adjacent panels so that said panels are held at an angle of 120° to each other; each of said panel rails having equal length interiorly attached vertical rail tubes shorter than said panel rails, a top piece received upon said rail tubes, said rail tubes being formed to receive rods passing through apertures in said top piece, said rail tubes and said bottom piece; said rods being of such length and being threaded at each end so as to receive nuts to fix said rods in position and thereby to provide support for said side panels.

2. An improved jewelry display stand according to claim 1 wherein said top piece has attached thereto at least one vertical upwardly directed threaded bolt of a length sufficient to protrude through said decorative lid to provide a means for attaching said lid to said jewelry stand by a wing nut, said wing nut and said bolt being partially concealed by said handle.

3. An improved jewelry display stand according to claim 1 further comprising a rotatable base attached to said bottom piece.

4. An improved jewelry display stand according to claim 3 wherein said rotatable base comprises an upper circular plate having an upwardly directed circular groove therein and a lower circular plate of smaller radius than said upper plate having a downwardly directed circular groove of equal radius as and opposing said upwardly directed circular groove, said upwardly directed and downwardly directed circular groove forming a race for spherical ball bearings placed therebetween, the periphery of said upper circular plate being extended downwardly and toward the center of said base to enclose and press upwardly the outer peripheral edge of said lower circular plate so as to hold said bearings in said race without impeding the rotation of said base and said downwardly turned periphery of said upper circular plate so as to form a seat for said rotatable base.

5. An improved jewelry display stand useful in preventing theft comprising a flat, horizontally disposed bottom piece; a plurality of substantially vertical, rectangular side panels of substantially equal height mounted on and secured to said bottom piece; each of said side panels connected to an adjacent side panel; said side panels being of equal width so that said display stand has a hexagonal cross-section; at least one of said side panels being a display side panel having a plurality of substantially vertical display arms extending perpendicularly from said display panel, a lid which is hexagonal and of sufficient area and shape to cover the tops of said display arms; each of said display arms having at least one vertically oriented slot, said vertically oriented slots in said display arms adjacent to each other facing and opposing each other so that jewelry display cards on which earrings and the like are mounted can be slidably mounted between and held by said display arms when said lid is detached from said jewelry display stand, but cannot be removed therefrom when said lid is attached; wherein said adjacent side panels are connected to each other by substantially vertical display panel rails, said panel rails having vertical slots therein conformed so as to receive said vertical edges of said adjacent panels so that said panels are held at an angle of 120° to each other; each of said panel rails having equal length interiorly attached vertical rail tubes shorter than said panel rails, a top piece received upon said rail tubes said rail tubes being formed to receive rods passing through apertures in said top piece, said rail tubes and said bottom piece; fixing means to fix each of said rods in position; said rods being of such length to receive said fixing means to fix said rods in position and thereby to provide support for said side panels.

* * * * *